United States Patent [19]

Belokin, Jr.

[11] 4,136,474

[45] Jan. 30, 1979

[54] ILLUMINATED OVERHEAD ADVERTISING DISPLAY

[76] Inventor: Paul Belokin, Jr., Rte. #4, Hayward, Wis. 54843

[21] Appl. No.: 795,796

[22] Filed: May 11, 1977

[51] Int. Cl.[2] ..... G09F 13/04

[52] U.S. Cl. ..... 40/559; 40/558; 40/561; 40/617

[58] Field of Search ..... 40/558-559, 40/561, 563, 570, 573, 575, 577, 617, 564

[56] References Cited

U.S. PATENT DOCUMENTS

| | | | |
|---|---|---|---|
| 1,735,040 | 11/1929 | Frederick | 40/563 |
| 1,782,721 | 11/1930 | Frenkel | 40/561 |
| 3,068,599 | 12/1962 | Myerson | 40/575 X |
| 3,984,931 | 10/1976 | Belokin, Jr. | 40/559 |

*Primary Examiner*—John F. Pitrelli
*Assistant Examiner*—Skillington, G. Lee
*Attorney, Agent, or Firm*—James E. Nilles

[57] ABSTRACT

An overhead sign having polyhedral sections tapered vertically in opposite directions, the lower section comprising downwardly converging translucent panels having picture transparencies backlighted by concentrated light from overhead fluorescent room lights while upwardly converging decorative opaque panels overhang the upper edges of the translucent panels to minimize front lighting and perceptively brighten the pictures viewed by customers as well as minimizing shadows on the display counters below the sign.

1 Claim, 6 Drawing Figures

12
18
34
38
32
28
14
10
26
20
24
30
22
16
36
40
30
52
70
BEER
50
48
54
58

44
52
3
40
46
58
4
68
72
70
48
3
58
4

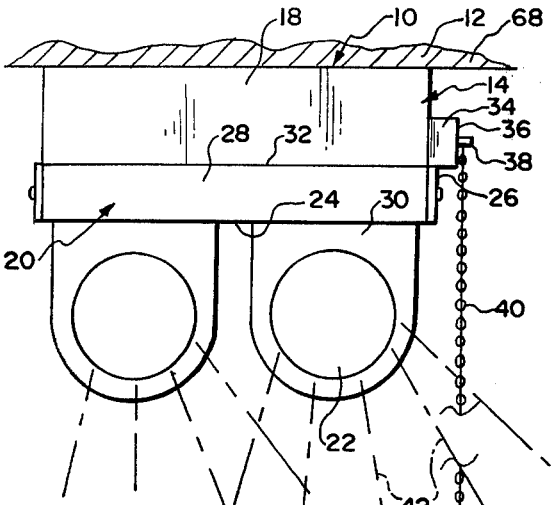
FIG. 3
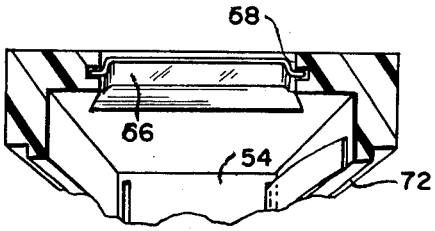
FIG. 4
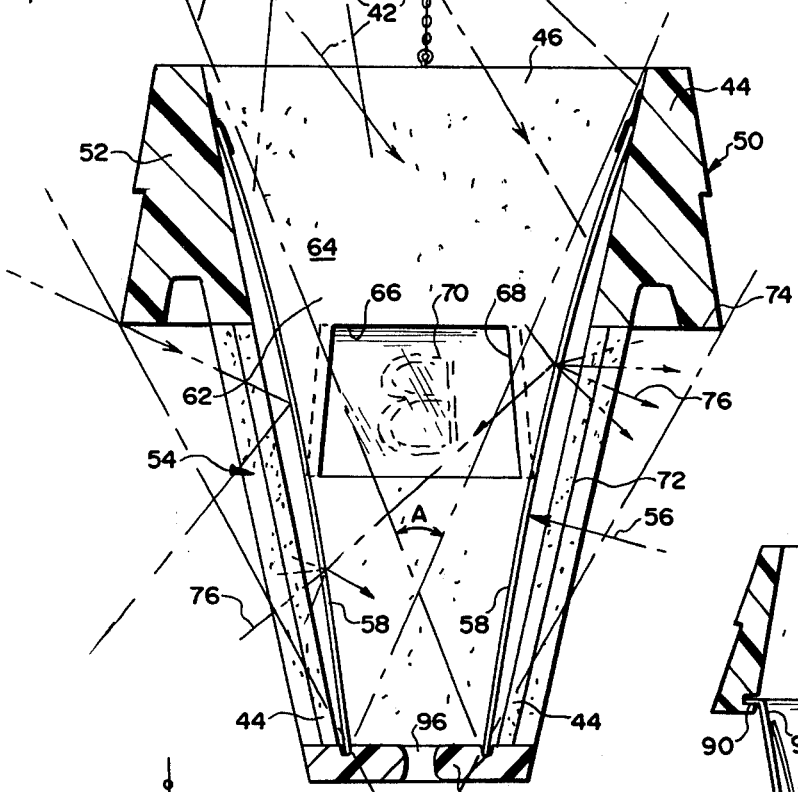
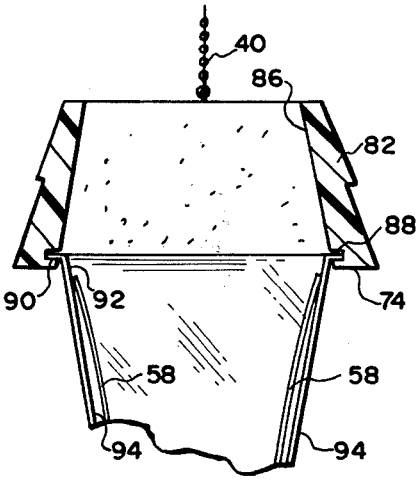
FIG. 6
FIG. 5
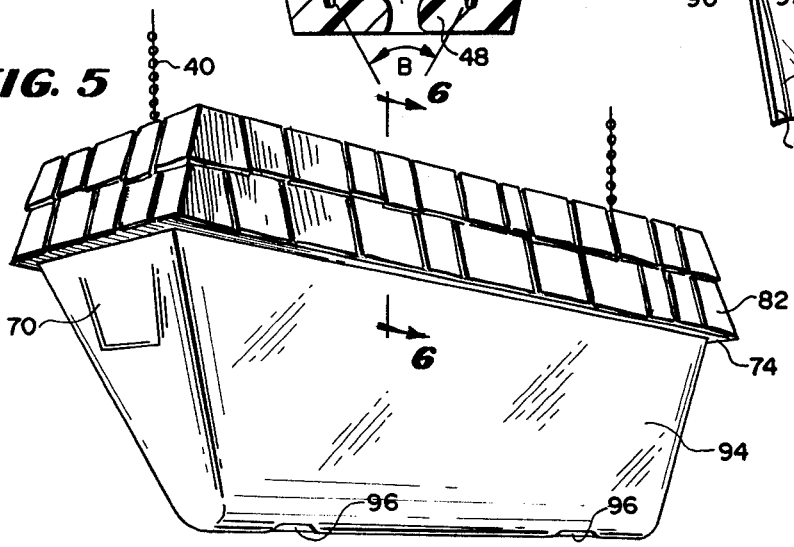

ILLUMINATED OVERHEAD ADVERTISING DISPLAY

BACKGROUND OF THE INVENTION

This invention is an improvement upon the invention disclosed in my U.S. Pat. No. 3,984,931, reference to which is hereby made, where some translucent panels subjected to front lighting may cause hazing of the signs and give the impression of "dusty" or dirty panels, or when subjected to the room lighting on both sides provide haze effects in which coloring, sharpness of lettering and picture transparencies and the overall readability is adversely affected by fluorescent light reflected to the viewer from the viewing side.

Also, room illumination on the back side coming through some interchangeable translucent panels may not individualize the panels with helpful clarity for normal perception, and a series of spaced signs tend to confuse customer selectivity as generally evidenced by customer fatigue, impatience, confusion or adverse opinion that a store is over-packed with signs or is a hard place to shop in.

Moreover, store signs disposed below light sources, as generally noted in the patent, are objectionable if they interfere with desired illumination of display counters. Accordingly, more and more fluorescent lighting is supported close to the ceiling with signs well below the fluorescent lights so that shadows are not cast by the signs upon display counters under them.

A series of translucent sign panels illuminated from the front as well as the back loses attention-attracting qualities for less thean average vision and as far as informative helpfulness is concerned, they merely are a part of the overall lighting system presented to customers in the store.

SUMMARY OF THE INVENTION

A unitized sign supported above eye level in a salesroom provides an easily viewed inverted polyhedral configuration in its lower portion having windows to receive translucent sign panels inclined from the vertical approximately 30 degrees. Also, in the preferred embodiment, a rectangular upright truncated polyhedral configuration is located on top of the lower portion as made of unitized molded elements suggestive of a shingled roof with its eaves overhanging the windows a substantial distance.

The two portions are open at the top and fluorescent light concentrations above the fixture spread downwardly and laterally through the opening to back light the sign panels in the window openings with bright concentrated overhead light rays while the eaves shade the viewed surfaces of the panels from bright overhead and reflected light to increase greatly the effective differential of illumination or visibility of the translucent panels. The greater the contrast, the more distinctly prominent will be the back-lighted panel wherever located above a reasonable eye level in a room, each panel being distinctive and distinguishable from others if perchance, several overlap partially either laterally or vertically as viewed by customers shopping in a store. Preferably, the ends of the panels are bordered by opaque or darkened corner moldings, one panel can then be visually and attentionwise isolated mentally from another overlapping it so that confusion is greatly reduced where panels are arrayed in sufficient numbers to assist and guide customers. Also the roof eaves effect provides a demarcation effect which not only is attractive as part of room decoration but it tends to arrest upward overmovement of a viewer's eyes who is rapidly looking for something particular.

Accessibility and ease in changing indicia or sign panels enables personnel to feature many different products from day to day with minimal trouble and effort.

IN THE DRAWINGS:

FIG. 3 is a section taken upon line 3—3 in FIG. 2;

FIG. 4 is a section taken upon line 4—4 in FIG. 2;

FIG. 5 is a perspective view from the bottom of another embodiment of the invention, taken from below the fixture; and FIG. 6 is a section taken upon line 6—6 in FIG. 5.

DESCRIPTION OF PREFERRED EMBODIMENTS

Figure 1:
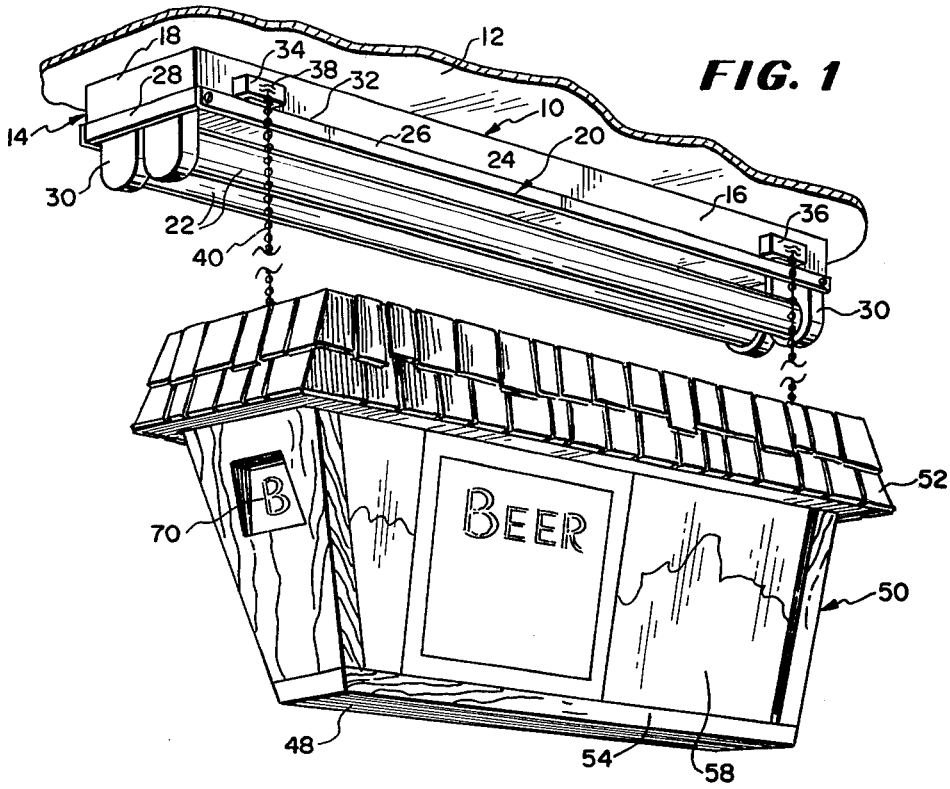
FIG. 1 is a perspective view of an embodiment of the invention in which the sign is in a fixture supported well below the ceiling and illustrates a preferred embodiment in perspective as viewed from below by a customer.

Referring now to the embodiment shown in FIG. 1, a fluorescent light fixture 10 is shown in a conventional position supported well above the floor or a display cabinet (not shown) in a room. By way of example, it is shown mounted on the ceiling 12 and has a housing 14 of a ferrous metal with vertical side walls 16 and end walls 18 which are open at the bottom through which the fluorescent circuit ballast is installed against the top wall. A bottom cover member 20 preferably having a downwardly light-reflective surface 24, has upturned side flanges 26 and end flanges 28 that overlap the vertical side walls 16 and 18 generally carry the fluorescent light receptacles 30 which receive fluorescent tubes 22. The upper edges of the cover 24 serve as upwardly facing shoulders 32 and weight supporting members 34 that rest on the shoulder 32 (FIG. 3) are held against the side walls 16 by magnets 36 preferably with the ends of the U-shaped magnets against the side 16 with the magnet located at the vertical center of the contacting surface of the supporting member 34.

As shown in FIG. 1, the ears 38 are disposed laterally of the housing 14 and the fluorescent tubes 22 located in the receptacles 30 to provide light rays 42. As illustrated in FIG. 3, the fluorescent light rays fan out laterally around the tubes 22 to illuminate a room, show cases and aisles (not shown) on the floor of the room.

A sign 50 is adjustably suspended on the chains 40 at any desired height, but preferably high enough for a person looking for sign information can see and read those signs close to him at a reasonable viewing distance. Thus, if desired, it is possible to have the chains 40 of spaced signs of progressively increasing adjusted lengths in a direction away from a store entrance. Accordingly, it is preferred for an acceptable illumination and viewing of the signs that the sign panel 58 be inclined towards the viewer (FIG. 3) so that it is disposed substantially normal to the expected line of sight 56 and also at an acute angle to all overhead lighting fixtures to prevent annoying reflections if surface of the panels 58 employed are highly reflective as distinguished from the soft diffused light transmitted by the preferred panels. Moreover, with the flexibility of the support 40, the fixture 10 can swing with attention-attracting movement with air circulating in the room.

Although the sign fixture 50 is preferably provided with more than one sign panel 58, arranged as a rectangle, it utilizes the overhead fluorescent light 22 to illuminate sign panels 58 by transmitting overhead light 42 through the panels thus back-lighting the panel.

The sign fixture 50 illustrated in FIGS. 1-4 may be a fabricated assembly of elements, but preferably is a unitized member, vacuum formed in one piece of a light material such as polystyrene. It comprises two side panels 44 (FIG. 3), two end walls 46 and a bottom wall 48. The panels 44 and walls 46 comprise two vertically spaced portions 52 and 54 whose inner faces collectively diverge and open upwardly to define a chamber 62 having a reflective wall 64 above the bottom wall 48 for the collection of downwardly directed fluorescent light rays 42 from the direction of the ceiling 12 and essentially from a concentration of rays directly above the chamber space 62.

The lower external portions 54 of the side walls 44 converge downwardly and the end walls 46 are apertured at 66 to provide end openings 68 to receive translucent display counter-identifying assemblies 70. The side walls 44 have windows 72 to receive translucent signs 58 to be viewed by customers.

The upper wall portions 52 diverge outwardly like a steep roof to terminate in eaves 74 that extend horizontally well beyond the plumb of the windows 72 to shade them from overhead light and thereby increase the desirable contrast between the intense back-lighting of the panels 58 transmitted to the viewer and the effect of the shaded front lighting 76 thereon.

By way of representing the relative angle between the sets of rays radiating from an elongated fluorescent tube, the angle at A (FIG. 3), which is preferably 50 to 60 degrees, indicates the angular scope of direct rays 42 contacting and reflecting upon the sign panels 58, preferably with the supporting chain 40 located on the side of the fixture 50 illustrated in FIG. 3, where viewing is most likely to occur, and the length of the fluorescent fixture indicating the multiple number of rays 76 as diffused and directed laterally through the sign panel. This concentration of rays operates to back-light the sign as viewed.

Considering the overhang reduction of front lighting of the sign causing a dimming of the image, the angle at B is preferably 60 to 70 degrees and represents the obstruction of all direct rays from the closest fluorescent source even when hung any distance below it.

Although the windows may receive transparent glossy panes, if desired, it is preferred to employ a translucent material treated to have appreciable light diffusing properites, and, particularly with any pictures or indicia disposed on the diffusing surface thereof for direct reading with brightness, clarity and illumination without any reflectivity of light from the viewed surface.

In this relation, any reflective surface of the sign assembly is preferably on that side of the treated translucent panel which is next to the source of light illuminating it. The beneficial reflection, collection and distribution of light rays within the cavity on that side of the picture opposite the viewed side distributes the rays over the surface and when they pass through the panel they are diffused on the other side and viewed with great clarity.

This not only improves visual performance but provides an easy rule to follow from time to time in changing signs, namely, to orient them in place so that they are viewed in reverse when viewed from inside the cavity when installing the new displays.

Accordingly, the translucent sign panel 58 with its faces inclined to the vertical, as indicated, is preferably formed as a unit and is transparent for interchangeable signs supported behind each viewing surface. Thus, interface transmission of reflected light to a person approaching and viewing the sign is provided as well and such forms an attention-attracting surface facing the viewer. Any attention distraction, or attracting reflection, is otherwise reduced by distance and is desirable only momentarily as a person approaches a succession of signs, particularly those capitalizing upon flashing reflections to attract attention. The back-lighting of the translucent sign would still dominate any momentary attention-attracting flashing.

The question generally is, whether an easily cleaned air-swayed swinging sign that attracts attention is less or more desirable than a diffusing surface which greatly reduces light reflections. Either can be provided. The invention enables either to be used, or both, in various combinations, the initially bright reflections being eliminated by the decorative eaves overhang that shades the viewed windows from the concentrated light source overhead that may be reflected against the sign and then to a person's eyes as the overhead inclined sign is approached by a person in a ceiling-illuminated merchandise display room. The preferred inclination is 30 degrees from the lower roof edge to the bottom of the sign portion, preferably in a room with a 10-foot ceiling.

The embodiment illustrated in FIGS. 5 and 6 is made in two sections. The upper roof-like overhanging member 82 which has the opening 86 through it with a groove 88 around its inside lower edge receiving in supported relation an outer flange 90 around the upper edge 92 of the lower vessel-like member 84 having downwardly tapering sidewalls 94 of translucent material. This member receives in supported relation signs 58 and markers 70 which lean against the sloping sides 94 and are visible through the wall of the vessel. With this construction the vessel can be removed and cleaned whenever desired and reinstalled merely by depressing the flanged sidewalls 94 toward each other to pass in and out of the groove 88. This easy attachment makes it possible to mount and remove quickly any signs to be displayed and provides the same benefits of back-lighting the signs with the lights from above as in the previously described embodiment of the invention disclosed in FIG. 1.

Preferably, in both embodiments, openings 96 of reduced size are provided through the bottom 98 for ventilation and cleaning the bottom of debris that collects there over a period of time. The signs can be inserted and removed from the top opening 86 through the upper portion.

Figure 2:
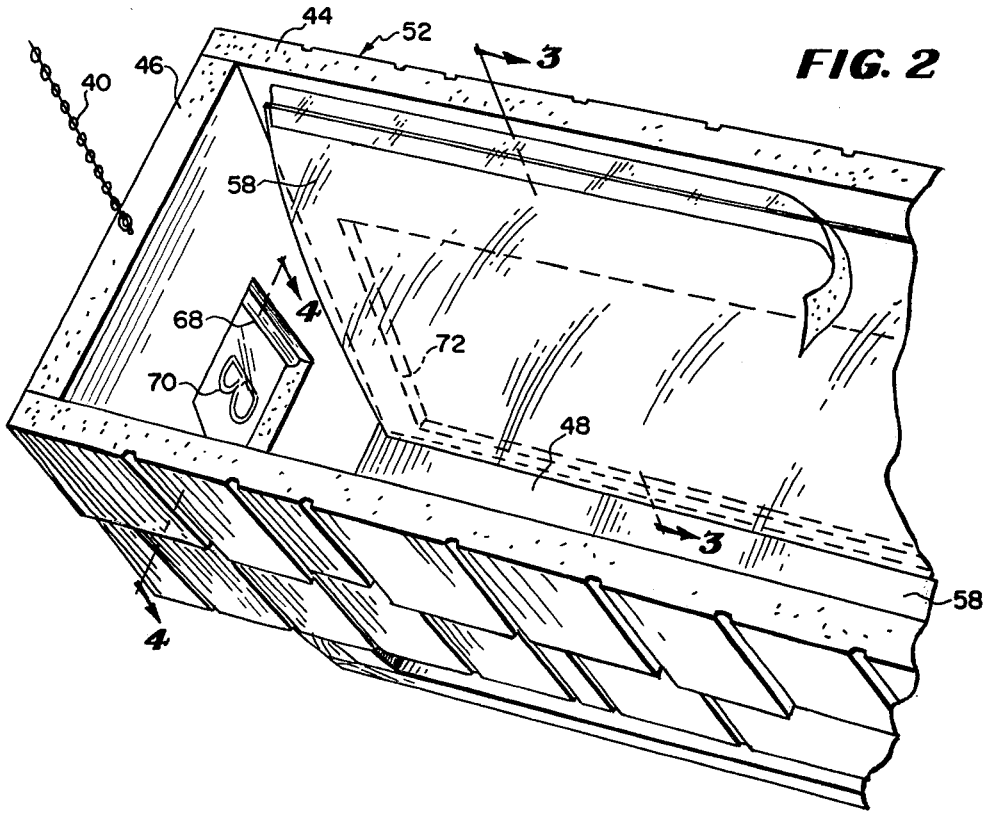
FIG. 2 is a perspective view from the top as from the ceiling illustrating the structure and the support of signs in the display fixture.

Also, in both embodiments the translucent signs may be easily inserted and removed from above the sign through the wide open illumination opening 86 and longitudinal or bottom grooves (not shown) can be provided in the bottom or floor 98 in which the lower edges of the signs can be inserted and held in place against dislodgement with the translucent signs 58 leaning against the inclined walls. In this relationship it is preferred to hold the upper edges of the signs against the inner sides around the openings by adhesive tape, as shown in FIG. 2 along the upper edge of the sign.

The rays are indicated by arrows in FIG. 3 where the sign is shown as located in its closest relationship with the fluorescent light fixture in a low ceiling room. A further advantage of the invention is that the flexbile chain 40 will permit the sign to be tilted approximately 90 degrees to replace the panel if not otherwise convenient to remove them. Also, one of the magnets can be disengaged momentarily for the same purpose, it being appreciated that the invention can be disposed at any distance from the fluorescent fixture wherever it is located in accordance with the desires of the store owner. Thus, it has a universal convenience for all stores lighted by fluorescent fixtures without any change in the equipment. Moreover, it is disposed above the reach of customers without any inconvenience to servicing the fluorescent fixtures and without any alteration of the room or lighting fixtures when installing or removing the sign.

Also, as noted, the sign can be hung on the side of the fluorescent fixture that is closer to the viewer for maximum intensity and greater use of incident light rays through the panel that is theirs to the concern of observers. This relationship assists in the shading effect of the overhanging eaves. The contrast between the back illumination effect and the front hazing effect of the viewed surface is particularly important where there is a diffusing medium between the two surfaces so that uniform lighting over the whole surface is maintained without shadows even in a brightly lighted room.

Furthermore, the signs lend themselves to supplemented display by easily placed color transparencies located between the fluorescent tubes 22 and the top 86 of the sign for various color decorations or distinctiveness of the signs. For instance, light green and light red transparencies can be used at Christmas time, purple and white at Easter time, or orange at Halloween. Thereby, the signs are adapted for seasonal events with a minimal amount of attention with or without changing the signs themselves.

Although the suspending chain 40 is shown broken to indicate variability in its length in FIG. 3, the possible relative location of the fluorescent light and of the sign is shown to illustrate that the eaves flange 74 extends far enough to cut off rays of tubes which otherwise could illuminate the viewing face of at least one of the panels and cause a hazing effect that would dim the perceptability of the sign behind the panel.

The longer length of chain will lower the sign as that lateral light contacting the panel is further diminished. The presence of the overhang 74 performs even to a better advantage the shading of the viewing face of the sign.

What is claimed is:

1. An overhead sign for disposition in spaced apart relationship below and for illumination from an elongated horizontally disposed light source which is simultaneously employed to illuminate a space below said overhead sign, said overhead sign comprising:

a translucent relatively resilient lower member comprising a pair of spaced apart side walls sloped inwardly and downwardly toward each other and a pair of spaced apart end walls;

each wall comprising an inner light-receiving surface and an outer light-emitting surface and at least some of said walls comprising an outwardly extending flange near the top thereof;

an opaque upper member to which said lower member is detachably connected and comprising a pair of spaced apart side walls and a pair of spaced apart end walls;

each wall of said upper member comprising an inner surface, an outer surface, and a lower surface;

a surface on at least some of said walls of said upper member having a groove releasably receiving the flange of the associated wall of said lower members to detachably connect said lower portion and said upper portion of said sign;

said outer surface sloping inwardly and upwardly relative to its associated inner surface, and said lower surface extending transversely away from said light-emitting surface of the associated lower wall, whereby said upper member permits direct illumination of said light-receiving surface from said light source but prevents direct illumination of said light-emitting surface from said light source, and permits illumination of said space below said sign from said light source;

and means on said sign for suspending said sign below said light source.

* * * * *